US010662041B2

(12) United States Patent
Boos

(10) Patent No.: US 10,662,041 B2
(45) Date of Patent: May 26, 2020

(54) HOOK BLOCK BASE BODY

(71) Applicant: Liebherr-Werk Ehingen GmbH, Ehingen (DE)

(72) Inventor: Bernd Boos, Mehrstetten (DE)

(73) Assignee: Liebherr-Werk Ehingen GmbH, Ehingen (DE)

( * ) Notice: Subject to any disclaimer, the term of this patent is extended or adjusted under 35 U.S.C. 154(b) by 69 days.

(21) Appl. No.: 16/125,306

(22) Filed: Sep. 7, 2018

(65) Prior Publication Data

US 2019/0077643 A1 Mar. 14, 2019

(30) Foreign Application Priority Data

Sep. 8, 2017 (DE) ..... 20 2017 105 449 U

(51) Int. Cl.

| | |
|---|---|
| ***B66D 3/08*** | (2006.01) |
| ***B66D 3/06*** | (2006.01) |
| ***B66C 1/34*** | (2006.01) |
| ***B66D 3/10*** | (2006.01) |

(52) U.S. Cl.

CPC ..... *B66D 3/08* (2013.01); *B66C 1/34* (2013.01); *B66D 3/06* (2013.01); *B66D 3/10* (2013.01); *B66D 2700/028* (2013.01)

(58) Field of Classification Search

CPC ... B66D 3/06; B66D 3/08; B66D 3/10; B66D 2700/028; B66C 1/34

See application file for complete search history.

(56) References Cited

U.S. PATENT DOCUMENTS

| | | | | | |
|---|---|---|---|---|---|
| 1,928,958 | A * | 10/1933 | Young | B66D 3/06 | 254/400 |
| 2,562,045 | A * | 7/1951 | Knaak | F16C 19/28 | 384/588 |
| 3,662,992 | A * | 5/1972 | Vittert | B66D 5/04 | 254/391 |
| 3,936,034 | A * | 2/1976 | Larralde | E21B 19/02 | 254/399 |
| 4,516,478 | A * | 5/1985 | Connelly | F01B 9/00 | 254/386 |
| 5,538,223 | A * | 7/1996 | Scace | B63H 9/10 | 254/391 |
| 5,918,701 | A * | 7/1999 | Rogelja | B66D 3/10 | 182/234 |
| 6,244,570 | B1 * | 6/2001 | Habberstad | B66D 3/046 | 254/399 |
| 6,386,516 | B1 * | 5/2002 | Lenders | B66D 3/046 | 254/393 |
| 6,595,494 | B1 * | 7/2003 | Roodenburg | B66C 13/02 | 254/277 |

(Continued)

*Primary Examiner* — Michael E Gallion

(74) *Attorney, Agent, or Firm* — McCoy Russell LLP

(57) ABSTRACT

The invention relates to a hook block base body for fastening to a pulley set of a hoisting apparatus having a plurality of deflection pulleys comprising a means for installing the hook block base body at the pulley set and a load suspension means for suspending a load, characterized by at least one projection element that is configured to cooperate with a deflection pulley on an installation of the hook block base body at the pulley set and only to permit an installation of the hook block base body at the pulley set when the deflection pulley cooperating with the projection element is rope-free.

20 Claims, 1 Drawing Sheet

(56) References Cited

U.S. PATENT DOCUMENTS

| | | | | |
|---|---|---|---|---|
| 2009/0267039 | A1* | 10/2009 | Franzen | B66C 1/34 254/401 |
| 2010/0237641 | A1* | 9/2010 | Drent | B66C 1/34 294/82.11 |
| 2012/0012800 | A1* | 1/2012 | Chaumontet | A62B 1/10 254/391 |
| 2015/0183624 | A1* | 7/2015 | Maurice | B66D 3/02 254/399 |
| 2018/0170727 | A1* | 6/2018 | Yao | B66D 3/06 |

* cited by examiner

HOOK BLOCK BASE BODY

CROSS REFERENCE TO RELATED APPLICATION

This application claims priority to German Utility Model Application No. 20 2017 105 449.7, entitled "Hakenflaschengrundkörper," filed Sep. 8, 2017, the entire contents are hereby incorporated by reference in its entirety for all purposes.

TECHNICAL FIELD

Background and Summary

The present invention relates to a hook block base body and to a hook block having such a hook block base body.

In a crane, the hoist rope typically runs over one or more hoisting drums that are arranged at the boom tip to a hook block arranged below the boom tip. On a length change of the hoist rope, the hosting height of the hook block changes accordingly. The number of perpendicular strands formed by the hoist rope between the boom tip and the hook block determines the lifting force available to the block hook. So that the crane can also work under different deployment conditions, the number of strands (=the number of perpendicular strands of the hoist rope between the boom tip and the hook block) and the required hook block can be adapted.

Hook blocks are also known in which a load suspension means can be changed. The operator can thus change between a hook and a gripper, with it not being necessary to perform the sheeving of the block again. It is also known to replace parts from a large hook block that is designed for hoisting a high weight to form a small hook block that is designed for hoisting a smaller weight.

Since a small hook having a smaller number of reevings (that is, having a small number of strands) can perform faster hoist movements, it is sometimes of advantage to reduce the reevings. The available rope length on the winch is also a criterion. A lifting hook furthermore as a rule has a specific weight that is adapted to the hook size and to the provided number of reevings. It is namely necessary that the total weight of the lifting hook (including all additional weights) is able to withdraw the hoist rope with its number of reevings from the hoist winch on the lowering of the hook. This withdrawal takes place against the weight of the hoist rope on the rear side of the boom and against the friction in the hoisting drums. On traveling a load, it is of advantage for the travel speed to use the smallest possible hook and the smallest possible reeving.

If a small hook is used and if the reeving of the hoist rope is not coordinated to it, this can result in an unwanted overload of the small hook block since a rope winch drive can lift a load that is overdimensioned for the small hook due to the high number of strands, but the hook block does not have to be designed for such a weight.

It is the aim of the present invention to avoid an unwanted overload of a small hook block and to ensure that the reeving of the hoist rope is coordinated with the use of a specific hook.

This is done using a hook block base body in accordance with claim 1 of the present claims. The hook block base body accordingly comprises a means for installing the hook block base body at a pulley set and a load suspension means for suspending a load for the fastening to the pulley set of a hoisting apparatus having a plurality of deflection pulleys. The hook block base body is characterized in that at least one projection element is provided that is configured to cooperate with a deflection pulley on an installation of the hook block base body at the pulley set and to permit an installation of the hook block base body at the pulley set only when the deflection pulley cooperating with the projection element is rope-free.

Rope-free in this connection means that the deflection pulley cooperating with the projection element does not cooperate with the hoist rope or is not reeved with the hoist rope.

It is advantageous in the hook block base body in accordance with the invention that it is ensured by the projection element that engages into a deflection pulley on an installation with the pulley set that the hoist rope can only be reeved in deflection pulleys coordinated with the hook block base body. The projection element namely prevents an installation of the hook block base body and the pulley set if that deflection pulley that cooperates with the projection element is reeved with the hoist rope. The at least one projection element thus ensures that that reeving is also actually carried out at the pulley set that matches the associated hook block base body. An unwanted overload of the hook block having the hook block base body due to a non-coordinated reeving can thus not occur. The case is also covered by the invention that the hook block base body has two or more projection elements of which each is configured to cooperate with a respective deflection pulley.

In accordance with an advantageous modification of the present invention, the means for installing the hook block base body at the pulley set is a recess that can be used for the installation at the pulley set via a pin connection.

The projection element can thus prevent the flush moving over one another of the two recesses of the hook block base body and the pulley set required for a pin connection if the rope is reeved on deflection pulleys that are not intended for the hook block base body. A fastening of the two components to one another is then not possible.

The load suspension means is here preferably a hook or a gripper.

In accordance with a further development of the invention, the at least one projection element is configured to engage into a peripheral groove for guiding a hoist rope of the deflection pulley in a state of the hook block base body installed at the pulley set, with an installation of the hook block base body with the pulley set preferably only being possible when the deflection pulley into which the projection element engages is not reeved.

Provision is accordingly made that the projection element of the hook block base body cooperates with or engages into the groove for taken up a hoist rope of a deflection pulley of the pulley set. If the hoist rope is present in the groove, no engagement of the projection element in this groove takes place so that an alignment required for fastening the pulley set to the hook block base body cannot be carried out successfully.

Provision can further be made that the at least one projection element for the engagement into the peripheral groove of a deflection pulley serves to ensure that the hook block base body only cooperates with a reeving matching it or with a reeving of the pulley set coordinated with it.

In accordance with a further modification of the present invention, each projection element is configured to cooperate with a deflection pulley of the pulley set that is not the center deflection pulley and/or the symmetrical pair of deflection pulleys or the center deflection pulley of the pulley set.

Accordingly, only deflection pulleys arranged at the marginal side are checked as to whether a reeving with the hoist rope takes place. The center deflection pulleys or the center deflection pulley continue/continues to remain free for a reeving with the hoist rope to enable a hoisting procedure of the hook block base body in its state installed at the pulley set. It is of advantage here if the center deflection pulleys or the center deflection pulley of the pulley set are/is used for this purpose since then the pulley set is uniformly stressed. The plurality of projection elements of the hook block base body accordingly advantageously do not act on the center deflection pulleys or on the center deflection pulley of a pulley set.

The invention further comprises a hook block having a hook block base body in accordance with one of the above-listed variants and having a pulley set that has a plurality of deflection pulleys. The pulley set can here accordingly be configured in accordance with one of the above-listed variants. The pulley set here has a plurality of deflection pulleys that are preferably arranged along a common straight line with its axis of rotation. Provision can furthermore be made that the deflection pulleys are all of the same size or are even identical. A typical pulley set, for example, comprises 3 or 5 deflection pulleys.

The hook block is here of modular construction and comprises a hook block base body and a pulley set that can be brought into connection therewith. If it is now desired to provide a smaller hook at a pulley set to increase the travel speed, a hook block base body in accordance with the invention that permits a comparatively smaller load suspension can be used instead of a hook block base body that has no projection elements.

Provision can additionally be made that the hook block has a hook block weight that is fastenable to the hook block base body or to the pulley set. The fastening thereto can likewise be provided by means of a pin connection.

In accordance with a further development of the present invention, the at least one projection element of the hook block base body is configured to ensure that the reeving of the pulley set coordinated with the hook block base body is present on an installation. It is thereby avoided that an overload of the hook block base body or of the hook block of a modular construction occurs.

The invention further comprises a crane having a hook block base body in accordance with one of the above-listed variants or having a hook block in accordance with one of the above-listed variants.

BRIEF DESCRIPTION OF THE FIGURES

Further features, details and advantages of the present invention will become clear with reference to the following description of the Figures.

DETAILED DESCRIPTION

Figure 1:
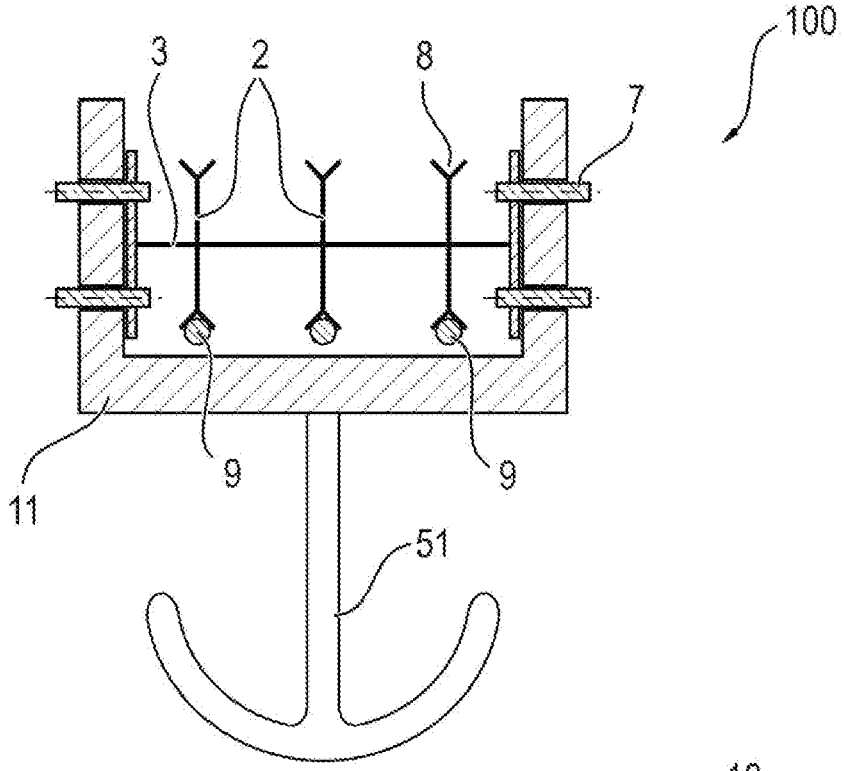
FIG. 1 Prior Art
FIG. 1 shows a schematic representation of a hook block comprising a pulley set and a hook block base body in accordance with the prior art.

FIG. 1 shows a "strong" hook block 100 that is configured for hoisting a heavy load. The hook block 100 here has a large lifting hook 51, a hook block base body 11 and a pulley set 3 that has a plurality of deflection pulleys 2. It can be recognized here that the hoist rope 9 runs over each of the plurality of deflection pulleys 2, that is, it is reeved in every deflection pulley 2. It can additionally be recognized that the pulley set 3 is separable from the hook block base body 11 with the aid of the pins 7. Provision can furthermore be made that hook block weights (not shown) are attached to the pulley set 3 or to the hook block base body 11.

Figure 2:
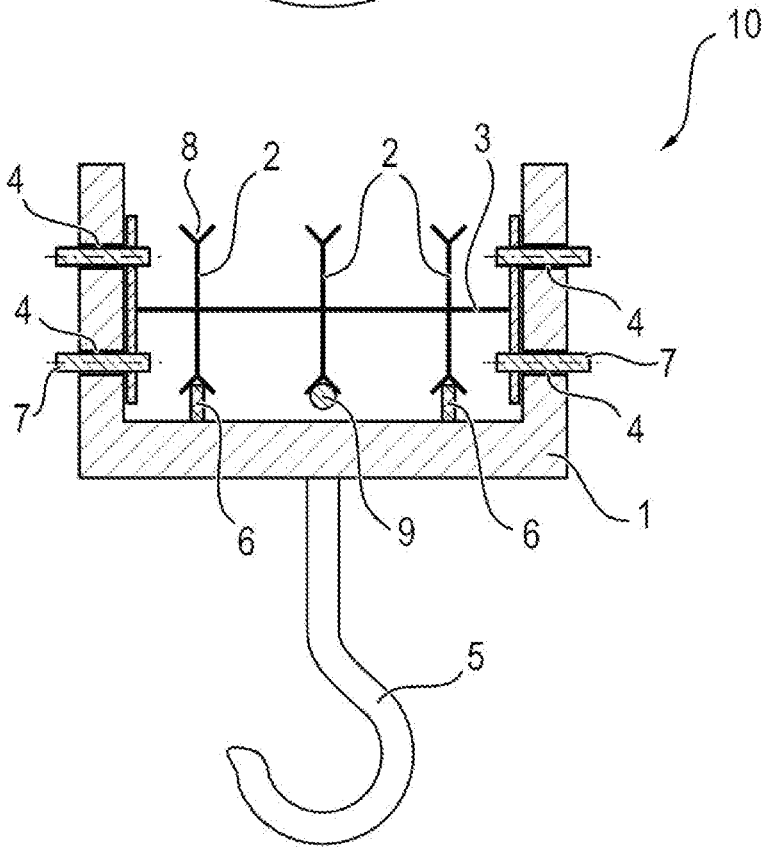
FIG. 2 shows a schematic representation of a hook block in accordance with the invention.

FIG. 2 now shows a schematic representation of the hook block 10 in accordance with the invention that has a hook block base body 1 in accordance with the invention. If, for example, a user endeavors to replace the "strong" hook block 100 previously described in FIG. 1 to raise heavy loads with a "weak" hook block 10 (as shown in FIG. 2) to hoist less heavy loads, this also brings about a change of the reeving for the optimization of the work speed. The changed reeving is also of great importance with respect to a possible overload of the "weak" hook block 10 so that an operation with a reeving coordinated with the hook block base body 1 is of great importance.

The number of strands n=7 used in FIG. 1 is thus reduced to the number of strands n=3 with the "weak" hook block 10. It is thus clear that a new reeving has to be carried out. The payload of the lifting hook 5 and the number of strands is only coordinated with one another in this way.

As can be seen from FIG. 2, the hoist rope 9 is guided over the center deflection pulley 2. The number of strands accordingly amounts to n=3. On the connection of the base body 1 to the pulley set 3, the projections 6 approach the deflection pulleys 2 and engage in the peripheral groove 8 of the deflection pulleys 2. It is a requirement for a complete connection between the pulley set 3 and the hook block base body 1 that the projections 6 and the deflection pulleys 2 are so close to one another that there is no longer any room for a hoist rope 9 between the projection elements 6 and the deflection pulleys 2. A connection of the pulley set 3 and the hook block base body 1 can accordingly only take place when the corresponding reeving for the hook block base body 1 has been carried out at the pulley set 3. If this is not the case, the projection elements 6 provide that the recess 4 of the hook block base body 1 cannot be aligned flush with the corresponding recess at the pulley set 3 so that the pin connection 7 cannot be used successfully.

On a conversion to a configuration shown in FIG. 2 it is accordingly always ensured that the new reduced reeving takes place at the pulley set since otherwise the connection of the two hook block components cannot be carried out.

The invention claimed is:

1. A hook block base body for fastening to a pulley set of a hoisting apparatus having a plurality of deflection pulleys comprising:

a means for installing the hook block base body to the pulley set;

a load suspension means for suspending a load; and at least one projection element that is configured to cooperate with a deflection pulley of the plurality of deflection pulleys on an installation of the hook block base body at the pulley set and only to permit an installation of the hook block base body at the pulley set when the deflection pulley cooperating with the projection element is rope-free.

2. The hook block base body in accordance with claim 1, wherein the means for installing the hook block base body at the pulley set is a recess that is usable for the installation at the pulley set via a pin connection.

3. The hook block base body in accordance with claim 1, wherein the load suspension means is a hook or a gripper.

4. The hook block base body in accordance with claim 1, wherein the at least one projection element is configured to engage into a peripheral groove for guiding a hoist rope of the deflection pulley in a state of the hook block base body installed at the pulley set, with an installation of the hook block base body with the pulley set only being possible when the deflection pulley is not reeved.

5. The hook block base body in accordance with claim 4, wherein the at least one projection element for engaging into the peripheral groove of a deflection pulley serves to ensure that the hook block base body only cooperates with a reeving of the pulley set matching it.

6. The hook block base body in accordance with claim 1, wherein each projection element is configured to cooperate with a deflection pulley of the pulley set that is not a center pair of deflection pulleys or a center deflection pulley of the pulley set.

7. A hook block comprising:

a pulley set of a hoisting apparatus including a plurality of deflection pulleys; and a hook block base body for fastening to the pulley set, the hook block base body comprising:

a recess for installing the hook block base body to the pulley set;

a load suspender for suspending a load; and at least one projection element that is configured to cooperate with a deflection pulley of the plurality of deflection pulleys on an installation of the hook block base body at the pulley set and only to permit an installation of the hook block base body at the pulley set when the deflection pulley cooperating with the projection element is rope-free.

8. The hook block in accordance with claim 7, further comprising a hook block weight that is fastened to the hook block base body or to the pulley set.

9. The hook block in accordance with claim 7, wherein the at least one projection element of the hook block base body is configured to ensure that the reeving of the pulley set corresponding to the hook block base body is present on an installation.

10. A crane comprising:

a hook block base body for fastening to a pulley set, the hook block base body comprising:

a recess for installing the hook block base body to the pulley set;

a load suspender for suspending a load; and at least one projection element that is configured to cooperate with a deflection pulley of the plurality of deflection pulleys on an installation of the hook block base body at the pulley set and only to permit an installation of the hook block base body at the pulley set when the deflection pulley cooperating with the projection element is rope-free.

11. The hook block in accordance with claim 7, wherein the recess is usable for the installation at the pulley set via a pin connection.

12. The hook block in accordance with claim 7, wherein the load suspender is a hook or a gripper.

13. The hook block in accordance with claim 7, wherein each projection element is configured to cooperate with a deflection pulley of the pulley set that is not a center pair of deflection pulleys or a center deflection pulley of the pulley set.

14. The hook block in accordance with claim 7, wherein the at least one projection element is configured to engage into a peripheral groove for guiding a hoist rope of the deflection pulley in a state of the hook block base body installed at the pulley set, with an installation of the hook block base body with the pulley set only being possible when the deflection pulley is not reeved.

15. The crane in accordance with claim 10, further comprising the pulley set.

16. The crane in accordance with claim 10, further comprising a hook block weight that is fastened to the hook block base body or to the pulley set.

17. The crane in accordance with claim 10, wherein the at least one projection element of the hook block base body is configured to ensure that the reeving of the pulley set corresponding to the hook block base body is present on an installation.

18. The crane in accordance with claim 10, wherein the recess is usable for the installation at the pulley set via a pin connection.

19. The crane in accordance with claim 10, wherein the load suspender is a hook or a gripper.

20. The crane in accordance with claim 10, wherein each projection element is configured to cooperate with a deflection pulley of the pulley set that is not a center pair of deflection pulleys or a center deflection pulley of the pulley set.

* * * * *